US005993199A

United States Patent [19]

Safarik

[11] Patent Number: 5,993,199

[45] **Date of Patent: *Nov. 30, 1999**

[54] TURBO-FLAME BURNER DESIGN

[76] Inventor: Charles R. Safarik, 7820 N. 56th St., Tampa, Fla. 33617

[ * ] Notice: This patent issued on a continued prosecution application filed under 37 CFR 1.53(d), and is subject to the twenty year patent term provisions of 35 U.S.C. 154(a)(2).

[21] Appl. No.: 08/880,310

[22] Filed: Jun. 24, 1997

Related U.S. Application Data

[60] Provisional application No. 60/020,361, Jun. 24, 1996.

[51] Int. Cl.[6] ..... F23Q 9/00

[52] U.S. Cl. ..... 431/284; 431/174; 431/184; 431/186; 431/188; 431/278; 239/424; 239/418

[58] Field of Search ..... 431/174, 175, 431/181–184, 186–188, 278, 284, 330; 239/423, 424, 418

[56] References Cited

U.S. PATENT DOCUMENTS

| | | | |
|---|---|---|---|
| 1,713,260 | 5/1929 | Chandler | 239/424 |
| 2,180,190 | 11/1939 | Baro . | |
| 3,283,802 | 11/1966 | Farnham | 431/186 |
| 3,811,277 | 5/1974 | Markowski . | |
| 3,879,939 | 4/1975 | Markowski . | |
| 3,919,840 | 11/1975 | Markowski . | |
| 4,298,337 | 11/1981 | Butler et al. . | |
| 4,341,512 | 7/1982 | Wojcieson et al. . | |
| 4,431,403 | 2/1984 | Nowak et al. . | |
| 4,443,182 | 4/1984 | Wojcieson et al. . | |
| 4,461,146 | 7/1984 | DuBell . | |
| 4,559,009 | 12/1985 | Marino et al. . | |
| 4,976,607 | 12/1990 | Grimard | 431/174 |
| 5,083,382 | 1/1992 | Brashears . | |
| 5,192,204 | 3/1993 | Musil . | |
| 5,259,755 | 11/1993 | Irwin et al. . | |
| 5,263,849 | 11/1993 | Irwin et al. . | |
| 5,415,539 | 5/1995 | Musil . | |

OTHER PUBLICATIONS

Starjet, pp. 2–7, dated Dec. 1994.

Astraflame, Four pages, undated.

"HM High Momentum Burners Gas, Oil & Combination" Hauck Manufacturing Company pg. HMC/HMG 1–3 dated 1990.

ECO–STAR, Hauck Manufacturing Company, pp. ES–2 to ES–3.1 dated Feb. 1994 and Mar. 1995.

*Primary Examiner*—Carroll B. Dority

*Attorney, Agent, or Firm*—Kerkam, Stowell, Kondracki & Clarke, P.C.; John C. Kerins

[57] ABSTRACT

A burner design for use especially with rotary dryers is provided, in which a primary firing tube is provided with an oil body disposed proximate the burner tip portion of the firing tube, the oil body being constructed to divide an airflow into an outer portion flowing through an outer airstream passageway and an inner portion flowing through an inner airstream passageway, and to cause said inner and outer portions to intersect each other proximate the burner tip portion. The oil body is further provided with a slit opening on an inner surface thereof along a boundary of the inner airstream passageway, the slit opening being in fluid communication with a supply of fuel oil, whereby fuel oil can be delivered at low pressure at an inner surface of the oil body, whereupon the inner airstream portion will cause the fuel oil to film along the inner surface of the oil body and to be intersected by the inner and outer airstream portions to atomize the fuel oil at the burner tip. A secondary air body surrounds one or more primary firing tubes and provides air to the firing tubes for a fuel/air premix, and provides swirling air surrounding the primary firing tube at the burner tip portion.

17 Claims, 2 Drawing Sheets

TURBO-FLAME BURNER DESIGN

This application is directed to an invention that has been described and depicted in U.S. Provisional Application Ser. No. 60/020,361, filed Jun. 24, 1996.

BACKGROUND OF THE INVENTION

1. Field of the Invention

The present invention is directed to a burner configuration, and more particularly to a burner design adapted for use in rotary dryers, such as asphalt dryers, and in boilers and furnaces, which design enables the efficient burning of gaseous fuel or fuel oil.

2. Description of Related Art

Illustrative of the prior patents issued in the field of burners used, for example, in rotary dryers, furnaces, and boilers, are the following patents:

| U.S. Pat. No. | Inventor |
|---|---|
| 4,298,337 | Butler et al. |
| 4,341,512 | Wojcieson et al. |
| 4,431,403 | Nowak et al. |
| 4,443,182 | Wojcieson et al. |
| 4,559,009 | Marino et al. |
| 5,083,382 | Brashaars |
| 5,192,204 | Musil |
| 5,259,755 | Irwin et al. |
| 5,263,849 | Irwin et al. |
| 5,415,539 | Musil |

Companies such as Hauck Manufacturing Co. and Gencor are involved in the production and sale of burners used in rotary dryers, and companies that are presently selling burners for use in boilers and furnaces are Coen and Industrial Combustion/Webster.

Throughout the time period in which all of the above patents issued, and continuing through the present, the goals sought to be achieved in developing new burner designs are to provide a compact and efficient combustion burner, a burner having a large turn-down ratio, a burner that achieves greater flame stability, a burner that efficiently and readily burns both liquid and gaseous fuel, and a design that provides dependable operation and economical manufacture.

While several of the designs disclosed in the above patents have proven to be commercially viable, there is a continuing need for further improvements and enhancements in burner design in order to better achieve the desired goals.

It is therefore a principal object of the present invention to provide a burner design that achieves a high overall turn-down ratio when burning both liquid and gaseous fuel, by providing the burner with a unique nozzle design and improved air swirl adjustability.

It is an additional principal object of the present invention to provide a burner design that will burn both liquid and gaseous fuel through the same primary body, and which can be used to burn stoichiometrically or to burn with excess air or low air-fuel ratios.

It is a further important object of the present invention to provide a burner design that can be used under a wide variety of firing conditions, including being capable of firing liquid (such as oil) or gaseous fuel at lower horsepowers and using the same primary body for either fuel.

It is an additional important object of the present invention to provide a burner design in which the air capacity of the burner can be changed with minimal effort, thereby effectively providing a plurality of burner sizes for a single atomizing air body.

It is an additional important object of the present invention to provide a burner design in which the adjustment or trim of the flame oxygen content can be accomplished by direct movement of burner components, or by changing the available pressures to those components from an upstream valve.

It is yet an additional important object of the present invention to provide a burner design in which the primary firing body is designed to be capable of being stacked or clustered with additional identical primary bodies in constructing larger sized burners.

SUMMARY OF THE INVENTION

The above and other objects of the present invention are achieved in the present invention by providing a burner design comprising a primary firing body having a passage for atomizing air or gaseous fuel, and having an oil delivery and atomization subsystem, fitted into a secondary air body that supplies additional air for an air/gas premix, and that supplies swirled secondary air for varying and stabilizing the flame shape.

The primary firing body includes a primary air/gas passage that includes a valve to regulate the rate of fuel delivery. The primary body is fitted within a secondary air body, and the two components are constructed to allow a portion of the air from the secondary air body to be delivered into the primary air and gas passage to allow for pre-mixing of air with the fuel to be burned when burning a gaseous fuel. This makes for a very compact design for the burner, and allows for a staging of the fuel and air to minimize emissions.

The oil delivery and atomization subsystem forms a part of the primary firing body, and employs an atomizing air passage that is split into an inner and an outer part which are later rejoined in a manner such that the rejoining of the inner and outer parts causes the two streams of air to intersect a very thin sheet of oil, thereby atomizing the oil into a spray of extremely small droplets. The oil is delivered at low pressure and films or sheets along a cylindrical or other shaped oil body under the influence of the inner part of the atomizing air stream, and is thereby evenly and steadily delivered to the area at which the inner and outer air flows rejoin and intersect.

The oil body surrounds a pintel that is flared outwardly relative to the longitudinal axis of the primary firing body, such that the inner surface of the oil body and the outer surface of the pintel define the inner part of the air passage through the primary firing body. This passage directs the inner part of the air flow outwardly to intersect the axially flowing air passing through the outer part of the air passage at the location where the inner and outer parts of the air passage are rejoined. The position of the oil body and pintel can readily be adjusted, or "fine-tuned", relative to the primary firing body and/or the secondary air body to maximize the performance of the burner under a wide variety of conditions.

The secondary air body employs a multi-bladed air flow control damper to vary and regulate the air flow rate, using an external linkage connected to a main control actuator. The valve that controls the rate of fuel delivery may be coupled to the damper linkage, as by a linkage connected to the same lever as is the damper linkage. The portion of the secondary air that is not diverted to the primary firing body is passed to a distribution baffle, and then through a plurality of airfoil-type swirl vanes which swirl the secondary air around the exterior wall of the primary firing body, and out through the opening of a secondary air nose piece surrounding the primary firing body. The swirling secondary air exits the nose piece at approximately the same axial position as where the fuel and primary air are ignited. The secondary air swirl vanes are adjustable such that the air swirl can be adjusted from a normal low spin to a high spin, wherein the adjustable vanes can be linked to a control actuator, or can be positioned manually to achieve this desired effect.

The secondary air nose piece is designed to be readily detachable from the secondary air body, enabling the nose piece to be easily changed. Nose pieces of different diameter openings can be supplied with the burner, and can thus be changed out when it is desired to change the overall secondary air capacity of the burner within a limited range. This results in a burner design that, for the same primary firing body and secondary air body, can be set up with a number of different secondary air flow capacities. The burner design further permits a wider range of size variations through the clustering of primary bodies within an overall secondary air body.

BRIEF DESCRIPTION OF THE DRAWINGS

These and other features of the present invention and the attendant advantages will be readily apparent to those having ordinary skill in the art and the invention will be more easily understood from the following detailed description of the preferred embodiment taken in conjunction with the accompanying drawings wherein like reference characters represent like parts throughout the several views.

DETAILED DESCRIPTION OF THE PREFERRED EMBODIMENT

Figure 1:
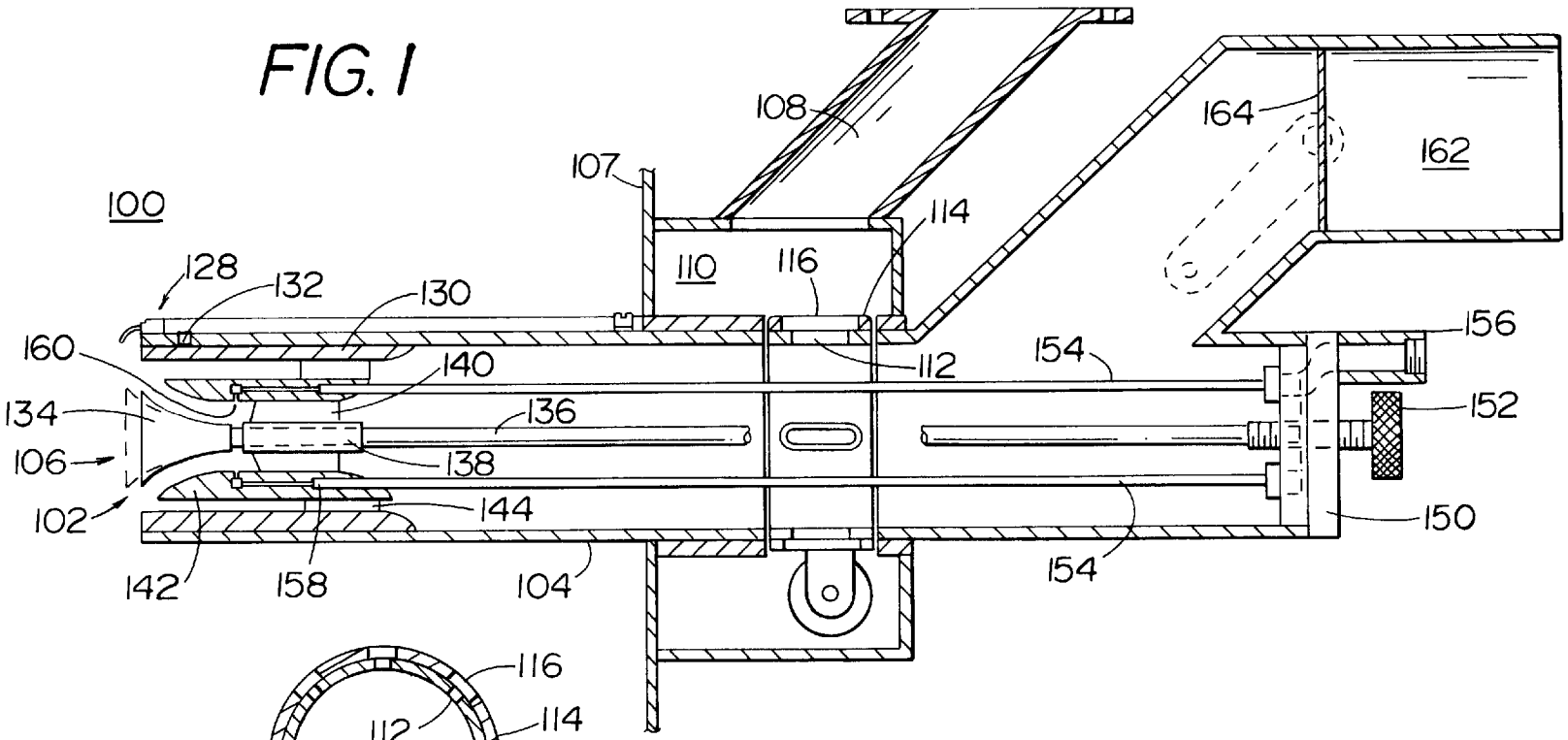
FIG. 1 is a side cross-sectional view of the burner design according to a preferred embodiment of the present invention.

Referring initially to FIG. 1 the burner 100 in accordance with a preferred embodiment of the present invention is depicted in cross-section.

The burner has a primary firing body 102 designed to feed air and fuel, such as gaseous fuel (gas) and/or fuel oil, in and through a primary firming tube 104, to the burner tip 106. Primary air for creating an air/gas premix is delivered through a portion of a secondary air body 107, namely, air duct 108, into a premix air plenum 110 surrounding the primary firming tube 104 at a rearward end thereof. The primary firing tube is provided with a plurality of longitudinal slots 112 (see also FIG. 3) to allow the primary air delivered to be premixed with the gaseous fuel being fired. The premix air plenum 110 is provided with a cylindrical slip ring 114 adjacent the area of the firing tube 104 having the slots therein. Slip ring 114 is provided with a corresponding number of slots 116 that will align with the slots 112 in the firing tube 104 to permit the premix air to be introduced into the gas flow in the firing tube.

Figure 3:
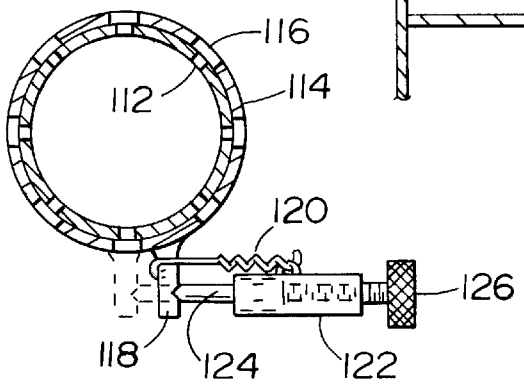
FIG. 3 is a sectional view of a preferred embodiment of an adjustable fuel/air pre-mixture construction, taken along section line A—A of FIG. 2.

As best seen in FIG. 3, eight longitudinal slots (shown from a radial cross-section perspective) may be provided in each of the firing tubes 104 and slip ring 114. The burner is provided with means for adjusting the amount of premix air to be delivered into the firing tube, illustrated in FIGS. 1 and 3 as a tab 118 attached to and extending below the slip ring or sleeve 114, a biasing or return spring 120 secured at one end to the tab 118, and at the other end to a casing 122 mounted to the firing body 102 at a predetermined distance away from tab 118. The casing 122 is bored and tapped to receive and house therein an adjustment rod 124 threaded over at least part of its length to engage the threaded part of casing 122. A fine adjustment dial 126 is disposed at a distal end of the adjustment rod, and will be accessible to equipment operators when the burner is in service.

The tab 118 and slip ring 114 are initially biased to the "open" position, at which the slots 112 of the firing tube and the slots 116 of the slip ring are fully aligned, allowing the maximum desired amount of premix air to flow from the surrounding plenum 110 to the interior of the firing tube 104. The fine adjustment dial may be turned to advance adjustment rod 124 in the direction of tab 118, thereby having tab 118 away from the fully open position to a continuum of positions at which the slots 116 of sleeve or slip ring 114 increasingly close off the slots 112 of firing tube 104, thereby decreasing the effective orifice opening, and the amount of premix air that will enter the firing tube in a given period of time. The return spring 120 arrangement can be replaced by a thread and gear arrangement (not shown) coupling sleeve 114 and adjustment rod 124.

It can be seen thus far that the burner design is kept relatively compact, in that the primary firing body 102 is designed to be inserted into, and surrounded by a secondary air body 107. As will be discussed later with respect to the secondary air body, ducting, vanes, baffles and a nozzle will preferably be provided to introduce swirling secondary air in a region surrounding burner tip 106.

At a proximal end 128 of firing tube 104, the tube is provided with an inner sleeve or insert 130 whose outer circumference is closely matched to the inner circumference of tube 104, and which can be secured in a series of desired positions by one or more set screws 132 threaded through tapped bores in the proximal end of the firing tube. Inner sleeve or insert 130 provides even support around the circumference of firing tube 104 to center the pintel 134 and associated components in the firing tube 104. It is designed also to increase the burner efficiency even when oil is not being burned, but rather only a gaseous fuel/air mixture. The sleeve 130, pintel 134, and the associated components will be referred to herein collectively as the oil delivery and atomization subsystem.

In the FIG. 1 embodiment, the oil delivery and atomization subsystem includes the pintel 134 mounted on pintel rod 136, with pintel rod 136 being supported within pintel sleeve 138. Pintel sleeve is, in turn, maintained in the center of firing tube 104 by a set of pintel support fins 140. Pintel support fins 140 are secured to an outer surface of the pintel sleeve 138, and extend radially outwardly, and extend axially substantially parallel to the central axis of firing tube 104. Pintel support fins 140 are secured at their outer extents to a substantially cylindrical oil body 142. Oil body 142 is in turn supported in a substantially concentric relationship to pintel sleeve 138 by a plurality of oil body support fins 144, which are secured to and extend between the outer surface of the oil body 142 and the inner surface of sleeve 130. The oil body support fins 144 may preferably be mounted such that the fins do not extend in parallel relation to the principal axis of firing tube 104, but rather the fins may be positioned angularly with respect to the burner axis (see, e.g., FIG. 2).

At the distal end of firing tube, the pintel rod extends through a rear cap or plate 150, and the cap 150 and pintel rod 136 are provided with corresponding threads, whereby the axial position of pintel 134 can be adjusted by turning the pintel adjustment dial 152. In the FIG. 1 embodiment, as the adjustment dial 152 is turned pintel rod 136 moves axially, sliding within pintel sleeve 138, thereby moving the pintel forward or rearward by, as desired. The remaining components of the oil delivery and atomization subsystem may also be moved axially, by loosening set screw 132 and manually sliding sleeve 130 and the components connected thereto.

In the FIG. 1 embodiment, fuel oil is supplied to the oil body 142 by way of fuel supply tubes 154, which are coupled to a fuel supply (not shown) at a threaded coupling 156 attached to rear cap 150. Oil body 142 has internal passages 158, and a small circumferential slit opening 160 on the inner peripheral surface of the oil body at a position slightly forward of center on the oil body.

The delivery of oil to this slit opening 160, unlike most oil burners, is intended to be accommodated by supply pressures to fully flood and fully distribute the oil to the filming surface of the oil body 142. The unique relationship between the oil body 142 and the pintel 134 serves to cause the air flow over the oil body to uniformly cover the oil body 142 and minimize the thickness of the film before it departs from the filming surface and becomes airborne as fine droplets. The oil droplet size, at any reasonable viscosity, emanating from the filming surface of oil body 142 is proportional to the air velocity over the oil body, the air pressure and the diameter of oil body 142. The centerline of the air flow passage between pintel 134 and oil body 142 describes or defines an angle of departure from the axis of this assembly which substantially influences the included angle of the spray pattern. This angle may be changed in order to accommodate the combustion zone. The curvature of the pintel may also be changed to maintain its relationship to the oil body.

Figures 2, 4:
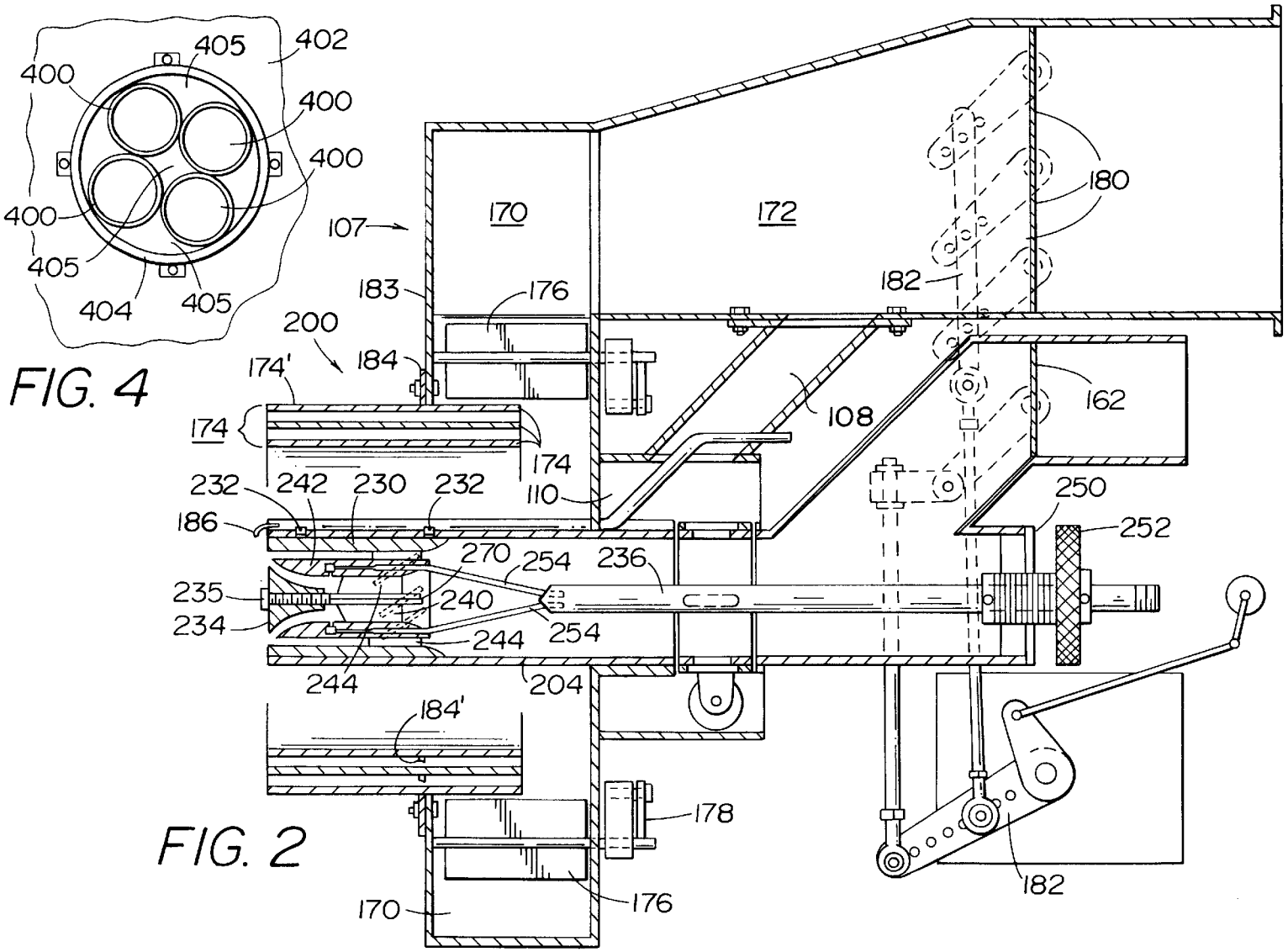
FIG. 2 is a side cross-sectional view of the burner design according to an alternative preferred embodiment of the present invention.
FIG. 4 is a substantially schematic front elevation view of a burner configuration in accordance with a preferred embodiment of the present invention, in which a plurality of firing tube are symmetrically arranged within a secondary air body to provide a higher capacity, highly efficient burner design.

The burner 100 is also provided with a gaseous fuel inlet duct 162, having a butterfly valve 164 control to regulate, as desired, the volume of gas introduced into the burner. This inlet duct may be used to introduce a gas/air mixture, which may then further be premixed with air introduced through slots 112, 116. Turning now to FIG. 2, an alternative preferred embodiment of the burner 200 of the present invention is illustrated. This figure also illustrates in greater detail the secondary air system 107, of which only duct 108 and premix air plenum 110 were shown in FIG. 1.

In FIG. 2, the primary firing tube 204 is of substantially the same construction as firing tube 104 in FIG. 1. At the proximal end of the firing tube, a sleeve or insert 230 is also provided much in the same manner as in FIG. 1, but sleeve 230 is shown as being securable at varying positions by a pair of set screws 232. Pintel 234 is of substantially the same external shape as pintel 134. However, in this embodiment, the pintel rod 236 extends only along part of the axial length of firing tube 204, from the distal end to a point short of the pintel located at the proximal end of the tube.

Pintel 234 is centered radially within firing tube 204 by being mounted in threaded engagement with a pintel center pod 270, with the pintel center pod being secured to and supported by a plurality of pod fins 240. Pod fins 240 are preferably aligned parallel to the main axis of firing tube 204, but may be oriented angularly with respect thereto. At their outer extent, pod fins 240 are secured to an inner surface of oil body 242, and an outer surface of oil body 242 is maintained at a constant spacing from sleeve 230 by a plurality of oil body support fins 244. These fins are preferably mounted to be angularly oriented to the main axis of the firing tube 204, substantially as shown in FIG. 2. These pod fins are typically oriented at 45° to the firing tube main axis and bear a relationship to the angle of the air passing over oil body 142, in order to optimize the atomization of the oil.

Pintel rod 236 extends through end cap 250, in threaded engagement therewith, and has an oil body position adjustment dial 252, by which the position of the oil body may be adjusted from the outside of the burner, provided that the set screws 232 have not been set to lock sleeve 230 in place. Alternatively, the oil body support fins 244 may be positioned to be in sliding engagement with the sleeve 230, instead of being permanently secured thereto. Pintel rod 236 terminates short of the position of the actual pintel 234, but has fuel supply tubes 254 housed within the pintel rod, and the fuel supply tubes 254 extend forwardly of the pintel rod, flaring out to the diameter of the oil body, and being secured thereto to provide an indirect coupling of the pintel rod to the pintel.

In this illustrated embodiment, the position of the pintel 234 may be adjusted by rotating the pintel on the threaded center pod 270 in the desired direction to cause the pintel to advance or retract. A retaining nut 235 may preferably be used on the end of the center pod 270 to secure the pintel 234 in the desired location.

The secondary air body 107 associated with the burner of the present invention is more completely illustrated in FIG. 2. In addition to the provision of the premix air duct 108 and premix air plenum 110, the secondary air body includes a swirl air subsystem comprising a swirl air plenum 170 and air supply duct 172. The swirl air plenum 170 feeds air to a swirl air nose piece or nozzle 174, through a plurality of position-adjustable air swirl vanes 176, that allow the air swirl to be changed from a normal low spin to a high spin by adjusting the angle of the fins relative to the axial center of firing tube 204. The swirl air vanes 176 have an airfoil type cross-section. The plurality of vanes 176 are operatively coupled to each other to set the vanes at the same angle relative to the axial center of the firing tube, for example, by mechanical linkage (not fully shown) operated by a single external lever 178. The air swirl pattern is changed to effect a desired flame shape variation, as, for example, will likely be desired when burning fuel oil instead of gaseous fuel.

The swirl air supply is preferably regulated to the swirl air supply duct 172 by a multi-bladed air flow control damper 180, that, through appropriate linkage 182, can be adjusted automatically with the adjustment of the gaseous fuel supply, regulated by butterfly valve 162. Other methods conventionally used in the art of fuel burners for controlling the overall air-fuel ratio may alternatively be used.

Swirl air passing through the swirl vanes is introduced into the swirl air nozzle 174, and the swirled air then emerges from the opening at the end of the nozzle to surround and aid in shaping and in stabilizing the flame generated at the burner tip. In the present invention, nozzles may be provided in various sizes for the same burner. The swirl air nozzle is designed in the present invention to be fastened to the front bulkhead 183 of the secondary air body 107 by bolting a flange 184 extending radially from the nozzle 174 to the bulkhead 183. The size of the opening in the bulkhead will generally determine the maximum size of the nozzle that can be employed with the burner, as seen for nozzle 174' in FIG. 2. For smaller nozzles that are to be used with the same burner, the flange 184 will protrude radially inwardly to a greater extent, such that it will be bolted to the bulkhead in the same manner, and will extend inwardly to its joint with the particular nozzle, as seen at 184' in FIG. 2. Nozzle diameters are proportional to flow rates which define their maximum capacity. The air nozzle size employed in any application will be selectable based upon the maximum firing rate, turndown, and atomizing air pressures.

A spark igniter electrode 186 is provided at the burner tip in order to fire the burner, although it would also be possible to employ gas pilot ignition, if desired.

In operation, the oil delivery and atomization subsystem provide for very efficient and very versatile burning of various fuels and mixtures of fuels, including fuel oil, gaseous fuels and mixtures thereof. When fuel oil is being burned exclusively, or as a mixture with gaseous fuel, the delivery and atomization subsystem more evenly and consistently atomizes the oil to produce a highly stable flame. When gaseous fuel is burned exclusively, the gas flow patterns and the ability to fine tune the positions of the pintel and oil body components, lead to improved burning of the gaseous fuel as compared with existing systems.

When oil is being burned, the atomizing air passages formed between the sleeve 130 and the outer surface of the oil body 142, and between the inner surface of the oil body 142 and the pintel 134, split the incoming atomizing air designed to be provided at a total of eight (8) to thirty-two (32) ounces per square inch gage, into two streams. The air flowing between the pintel and the inner surface of the oil body is directed outwardly at an angle to the burner axis. The air flowing between the outer surface of the oil body and the sleeve flows parallel to the burner axis. At the intersection of these two air flows, a very thin cylindrical or annular sheet of oil is intersected by the air flows, to produce an atomized oil spray of extremely small droplets.

It is to be noted that, while in the depicted preferred embodiment, the design uses an airflow that diverges from the burner axis, and an airflow that runs parallel to the burner axis and outside the diverging air stream, with the air streams intersecting each other and intersecting a thin sheet or film of liquid fuel, the specific depicted geometry of the components that accomplish this is not believed to be critical. Rather, it is the use, in general, of a burner geometry which has at least the two intersecting atomizing airstreams, which themselves also intersect a thin sheet of pre-filmed liquid fuel that leaves a filming surface at the region of the airstream intersection, that provides the types of improvements in burner performance and flexibility that are described herein. For example, a burner configuration could be provided in which an inner diverging airstream intersects an outer converging airstream, instead of an outer airstream flowing parallel to the burner axis. As a further example, the components are preferably, but need not necessarily be, annular, but could have other cross-sections, such as an oval cross-section or a partially square or rectangular cross-section.

The oil is introduced into the airstream through an oil orifice 160, which may preferably be a machined circumferential slot 160 in the oil body, extending around the entire inner circumference of the oil body. The oil stream, which is delivered at relatively low pressure, forms a sheet or film which completely coats the oil body under the influence of the atomizing air flow passing between the oil body and the pintel. The oil film proceeds to the very frontal sharp edge of the oil body, where it is intersected by the atomizing air flowing parallel to the burner axis between the outer surface of the oil body and sleeve 130. This manner of oil delivery, and the fine atomization of the oil resulting therefrom, creates a stabilized oil flame which may attach to the flat face of the pintel 134, which resides within the oil spray field. The main flame which develops at increased firing rates stabilizes at a point in the fuel and air pattern where the main stabilizing vortex suspends the burning fuel at a stationary front, while, as the firing rate is reduced, the attached minor flame joins with the major flame described. This contributes to or influences the exceptionally high turndown of the present burner design.

The fuel oil pressure requirements for this burner are low, in that the pressure need only accomplish the desired flow to gently flood the circumferential discharge slot for the purpose of having the oil adhere to the surface of the oil body, without significant air entrainment. The oil droplet size is determined by the diameter of the oil body at the leading knife edge of the oil body, the thickness of the oil film adhering to the oil body, and the air momentum passing over the oil film.

Another potential enhancement is that the oil body may be preheated, or separately heated to assist in burning heavier fuels that require higher oil temperatures for successful firing.

When gaseous fuel is being fired in the burner, the primary firing tube 104, which carries air at 24–32 ounces per square inch gage when oil is being fired, will instead carry gaseous fuel with varying levels of air premix. As noted previously, the amount of premix air admitted to the firing tube can be adjusted by opening and closing the slots 112, 116 to the desired level.

The adjustability of the pintel position, as it relates to gaseous fuel firing, allows for orifice adjustment to optimize flame stability. The variable positioning of the oil body further permits enhanced stability and enhanced turndown of the burner.

Turndown rates are even more dramatically positively affected as a result of the intersecting flow streams at the knife edge of the oil body. In firing gaseous fuel, the oil body does not deliver oil to the process, but continues to act as a gas stream flow divider and the knife edge at the forward end allows for a sharp intersection or rejoining of the gas streams. Further, when the fins supporting the pintel and oil body in position within the firing tube 104 are angled with respect to the burner axis, the gas streams are also swirled, which further enhances mixing and stability.

In some cases, it may be desirable to fire a liquid fuel which is propane, or butane, or other such fuel which is delivered to the nozzle under sufficient pressure to maintain its liquid state, precluding the need for a vaporizer system to otherwise gasify the fuel, such that an adjustment of the size of the opening of the oil orifice 160 permits the proper flow characteristic to then discharge the liquid fuel into the airstream passing across the filming surface, to then be further intersected by the second atomizing airstream. The size of the opening may be adjusted, for example, by constructing the oil body out of two mating threaded body sections, which each include one edge of the circumferential slot. When one body section is rotated relative to the other, the edges of the slot are brought closer together or moved farther apart to decrease or increase, respectively, the size of the opening.

Other aspects of the burner design of the present invention, applicable to both fuel oil firing and gaseous fuel firing include that the overall turndown of the burner may exceed 15:1 on any fuel, depending on the air/fuel ratio starting point of the high fire rate chosen, due to the nozzle design, the adjustability of the air swirl, and the unique nature of the ability of the burner to atomize liquid fuels at exceedingly low and variable atomizing air pressures, and, with gaseous fuels, the ability to provide air/fuel premix. The aerodynamic and thermal influences provide a fully developed, well mixed, totally stabilized flame and flow field. The design concepts employed in the present invention further produce the conditions necessary to provide lower levels of emissions of CO and $NO_x$ than for conventional methods of air and fuel mixing. The primary firing tube 104 may be extended beyond its position shown in FIG. 1 relative to the secondary air body 107 to permit flue gas recirculation, for greater $NO_x$ reduction, or for positioning within a refractory mixing throat.

The ability to reduce $NO_x$ emissions is also enhanced by the ability of the burner to maintain stability over the firing range when firing at excess air and gaseous fuel/air premix. Firing at excess air and with gaseous fuel/air premix is a known approach to reducing $NO_x$ while keeping carbon monoxide under controlled levels.

A further advantage of the burner design of the present invention, illustrated substantially schematically in FIG. 4, is that the design will allow a plurality of primary firing tubes 400 to be positioned within a single large secondary air body 402. In prior burner designs, if increased burner capacity or larger diameter flame were desired, the practice would be to scale up the size of all of the components to meet the greater needs. The scale up techniques employed by conventional design methods often compromise the design itself. In the present invention, a highly stable flame pattern can be created through the use of a plurality (four shown) of symmetrically arranged firing tubes within a secondary air body, projecting through a swirl air nose piece 404 and this configuration will provide the desired increased burner capacity. The preferred number of firing tubes to be used in this configuration is from three (3) to upwards of seven (7) firing tubes, all positioned to be surrounded by a single secondary air body.

Increasing the size/capacity of the burner using a stacking or clustering approach, as depicted, achieves success because each primary firing tube 400, also referred to as a primary air and gas body, is self-stabilizing, and the firing tubes are contained in an array in which the axial position and orientation has been established through balancing the tangential momentum of each primary body's flow field with an air flow field intermediately and adjacently positioned. The entire cluster is then stabilized with a surrounding vortex field formed by the balance of secondary air (107, FIG. 2) necessary to provide the total air requirements of the burner rating.

By clustering identical smaller primary bodies or firing tubes 400, which may themselves be made in two or three different sizes, the size of the bodies permit clusters of up to five or seven tubes, which results in the ability to produce many resulting overall burner sizes. The extreme wide range of stable performance of each primary body or firing tube further promotes the number of sizes of burners, not merely limited by the number of nozzles, but with the addition of burner ratings achievable from excess fuel rates, of up to three times stoichiometric burn rates, to over 100% excess air. Resultant turndowns will be in the range of 8:1.

Heretofore, efforts to provide a clustering of primary burner bodies to achieve a larger burner size of primary burner bodies to achieve a larger burner size have not been successful. However, the aforenoted high performance levels and unique characteristics of the primary burner body of the present invention make it possible to successfully cluster the primary bodies into a single burner of a larger burner size.

Each firing tube 400 is positioned in an air flow, wherein the air flow passes through the symmetrical spaces 405 between the tubes, which assists the interference zone of each of the firing tubes. Each firing tube may have a sleeve for directing swirled air to maintain full flame and overall burner stability. Overall flame shaping will be accomplished as in the single firing tube burner design, including using a swirled secondary airstream at the periphery of the firing tubes. The position of the firing tubes may be touching as showing, or spaced apart, depending upon the burner firing rate and application.

It should be appreciated that the foregoing description of the preferred embodiments of the present invention is provided for illustrative purposes only, and the scope of the invention is not intended to be so limited. Various modifications and changes to the preferred embodiments may become apparent to those of ordinary skill in the art after having had the benefit of studying the instant disclosure, with the modifications and changes being within the spirit and scope of the instant invention. Accordingly, the scope of the invention is to be determined in accordance with the appended claims.

What is claimed is:

1. A burner apparatus comprising:

a primary firing body having a primary firing tube with a passage extending therethrough and terminating at a burner tip portion;

an oil body positioned within said primary firing tube proximate said burner tip portion, said oil body having an axial extent, said oil body having an outer surface spaced apart from an inner surface of said primary firing tube, thereby defining an outer airstream passageway between said oil body outer surface and said firing tube inner surface;

said oil body further having a passageway extending through said oil body along said axial extent thereof, thereby defining an inner airstream passageway, said oil body and said inner surface of said primary firing tube being so constructed and arranged that said outer airstream passageway and said inner airstream passageway converge to force airstreams flowing through said inner and outer passageways to intersect proximate said burner tip portion, wherein said inner airstream passageway extending through said oil body is bounded by an inner surface of said oil body and by a pintel assembly disposed proximate said burner tip portion, and wherein said oil body further comprises a slit opening that opens into said inner airstream passageway, and wherein said slit opening is further in fluid communication with a fuel supply line.

2. A burner apparatus as recited in claim 1, wherein said inner surface of said primary firing tube and said outer surface of said oil body form a substantially annular outer airstream passageway extending substantially parallel to a longitudinal axis of said primary firing tube, and wherein said inner airstream passageway though said oil body is constructed to produce an airstream that flows in a radially diverging direction at an exit of said inner airstream passageway, and that intersects said airstream flowing through said outer airstream passageway.

3. A burner assembly as recited in claim 1, wherein said slit opening extends circumferentially around said inner surface, said slit opening being in fluid communication with a fuel supply line, whereby fuel oil can be delivered to said inner surface of said oil body and exposed to an airstream flowing therethrough.

4. A burner assembly as recited in claim 1, further comprising means for adjusting a position of said pintel assembly relative to a position of said oil body.

5. A burner assembly as recited in claim 1, wherein said inner surface of said oil body presents an opening of increasing diameter at its end nearest said burner tip portion, and wherein a surface of said pintel assembly facing said inner surface of said oil body correspondingly increases in diameter.

6. A burner assembly as recited in claim 1 further comprising a secondary air body surrounding said primary firing tube, said secondary air body being in fluid communication with said primary firing tube for delivering air into said primary firing tube, said secondary air body further having an air swirler comprising a plurality of swirl vanes and a secondary nose piece open adjacent to and surrounding said burner tip portion of said primary firing tube, said air swirler being so constructed and arranged to discharge secondary air at said burner tip portion, in a swirling pattern relative to a longitudinal axis of said primary firing tube.

7. A burner apparatus as recited in claim 6, wherein said plurality of swirl vanes are pivotable about mutually parallel axes, which axes are also substantially parallel to said longitudinal axis of said primary firing tube.

8. A burner apparatus comprising:

a primary firing body having a primary firing tube with a passage extending therethrough and terminating at a burner tip portion;

an oil body positioned within said primary firing tube proximate said burner tip portion, said oil body having an axial extent, said oil body having an outer surface spaced apart from an inner surface of said primary firing tube, thereby defining an outer airstream passageway between said oil body outer surface and said firing tube inner surface;

said oil body further having a passageway extending through said oil body along said axial extent thereof, thereby defining an inner airstream passageway, said oil body having a pintel disposed in said inner airstream passageway, said oil body, said pintel, and said inner surface of said primary firing tube being so constructed and arranged that said outer airstream passageway and said inner airstream passageway converge to force airstreams flowing through said inner and outer passageways to intersect proximate said burner tip portion, wherein said oil body has means for delivering fuel oil into said primary firing tube along a path of flowing air in said inner airstream passage, and said burner apparatus further has means for delivering gaseous fuel into said primary firing tube.

9. A burner apparatus comprising:

a plurality of primary firing bodies, each having a primary firing tube with a passage extending therethrough and terminating at a burner tip portion;

an oil body positioned within each of said primary firing tubes proximate an associated burner tip portion, each of said oil bodies having an axial extent, an outer surface spaced apart from an inner surface of said primary firing tube, thereby defining an outer airstream passageway between said oil body outer surface and said firing tube inner surface, and each of said oil bodies further having a passageway extending through said oil body along said axial extent thereof, thereby defining an inner airstream passageway, said oil body having a pintel disposed in said inner airstream passageway, said oil body, said pintel and said inner surface of said primary firing tube being so constructed and arranged that said outer airstream passageway and said inner airstream passageway converge to force airstreams flowing through said inner and outer passageways to intersect proximate said burner tip portion;

said plurality of firing bodies being clustered within a secondary air body comprising an air passageway, said air passageway being in fluid communication with an interior of each of said primary firing tubes, and said secondary air body further having an air swirler comprising a plurality of swirl vanes and a secondary nose piece open adjacent to and surrounding said burner tip portions of said primary firing tubes, said air swirler being so constructed and arranged to discharge secondary air at a position surrounding said burner tip portions, in a swirling pattern relative to the longitudinal axes of said primary firing tubes.

10. A burner apparatus as recited in claim 9, wherein said inner surface of each of said primary firing tubes and said outer surface of each of said oil bodies form a substantially annular outer airstream passageway extending substantially parallel to a longitudinal axis of each of said primary firing tubes, and wherein said inner airstream passageway though each of said oil bodies is constructed to produce an airstream that flows in a radially diverging direction at an exit of said inner airstream passageway, and that intersects said airstream flowing through said outer airstream passageway.

11. A burner apparatus as recited in claim 9, wherein said inner airstream passageway extending through each of said oil bodies is bounded by an inner surface of said oil body and by a pintel assembly extending axially through a hollow interior of said oil body.

12. A burner assembly as recited in claim 9, wherein each of said oil bodies further comprises a slit opening that opens into said inner airstream passageway, and wherein said slit opening is further in fluid communication with a fuel oil supply line, whereby fuel oil can be delivered into said inner airstream through said slit opening.

13. A burner assembly as recited in claim 11, wherein said inner surface of each of said oil bodies has a slit opening extending circumferentially around said inner surface, said slit opening being in fluid communication with a fuel oil supply line, whereby fuel oil can be delivered to said inner surface of each of said oil bodies and exposed to an airstream flowing therethrough.

14. A burner assembly as recited in claim 11, further comprising means for adjusting a position of each of said pintel assembly relative to a position of its associated said oil body.

15. A burner assembly as recited in claim 11, wherein said inner surface of each of said oil bodies presents an opening of increasing diameter at its end nearest said burner tip portion, and wherein a surface of said pintel assembly facing said inner surface of said oil body correspondingly increases in diameter.

16. A burner apparatus as recited in claim 9, wherein said plurality of swirl vanes are pivotable about mutually parallel axes, which axes are also substantially parallel to said longitudinal axes of said primary firing tubes.

17. A burner apparatus as recited in claim 9, wherein each of said oil bodies has means for delivering fuel oil into said primary firing tube along a path of flowing air in said inner airstream passageway, and wherein said burner apparatus further has means for delivering gaseous fuel into said primary firing tube.

* * * * *